United States Patent [19]

Akamatsu et al.

[11] Patent Number: 4,525,611

[45] Date of Patent: Jun. 25, 1985

[54] FLUID PRESSURE SWITCH

[75] Inventors: Osamu Akamatsu, Akashi; Masaaki Kitaue, Kobe, both of Japan

[73] Assignee: Nippon Air Brake Co., Ltd., Kobe, Japan

[21] Appl. No.: 478,576

[22] Filed: Mar. 24, 1983

[30] Foreign Application Priority Data

Mar. 24, 1982 [JP] Japan ..... 57-47885

[51] Int. Cl.[3] ..... H01H 35/40

[52] U.S. Cl. ..... 200/83 R; 200/83 S; 200/83 T

[58] Field of Search ..... 200/81.4, 81.9 M, 81.5, 200/82 A, 82 E, 83 S, 83 SA, 83 J, 83 R

[56] References Cited

U.S. PATENT DOCUMENTS

| | | | |
|---|---|---|---|
| 2,453,861 | 11/1948 | Rothwell | 200/83 SA X |
| 2,480,538 | 8/1949 | Barr | 200/81.5 |
| 2,533,559 | 12/1950 | Chipman | 200/81.4 X |
| 2,919,321 | 12/1959 | Lung | 200/83 SA |
| 3,056,004 | 9/1962 | Davis | 200/81.5 X |
| 4,007,344 | 2/1977 | Hipple | 200/83 SA |

*Primary Examiner*—A. D. Pellinen

*Assistant Examiner*—Susan Steward

*Attorney, Agent, or Firm*—George E. Hawranko

[57] ABSTRACT

A fluid pressure device for detecting two or more fluid pressure levels from a varied range of fluid pressure includes a housing having a cylindrical bore and a pressure inlet in communication therewith. A piston member is reciprocably movable within the cylindrical bore. A piston rod extends from the piston member and projects outward of the housing where a switch-operating arrangement is secured. The switch-operating arrangement includes an interlocking arm and a number of blocking elements corresponding to the number of switch devices to be operated. Guide slots formed in the interlocking arm allow adjustment of the position of the blocking elements, thus affecting a change in the operating points of the switch devices. Surrounding the piston rod within the housing is a multiple-spring arrangement which opposes the movement of the piston and which exhibits a nonlinear spring coefficient. The multiple-spring arrangement includes a plurality of springs arranged serially and a plurality of middle body members disposed between the plurality of springs for limiting the compression on the plurality of springs.

16 Claims, 9 Drawing Figures

FLUID PRESSURE SWITCH

BACKGROUND OF THE INVENTION

This invention pertains to a fluid pressure switch or device for detecting two or more distinct fluid pressure levels from a varied range of such levels; switches of this type are conventionally found in fluidic control systems. Typically, the detection of fluid pressure at various levels has been accomplished by installing a dedicated pressure switch for each fluid pressure level sought to be detected. Therefore, not only a large space was required in the switch, but also the installation and the maintenance of the switches were complicated and troublesome; moreover, the cost of the whole device was high.

Consequently, these problems led us to the invention of new fluid pressure switches which can detect fluid pressure levels at more than two points. The assignee of this patent application has applied for a patent for the fluid pressure switch based on FIG. 8 (Japanese patent application: 1978 No. 154419).

The fluid pressure switch, as shown in FIG. 8, has a piston 102 installed on the stepped hole 101 in the body 100, and one end of the piston is designed to be operated by the detecting fluid pressure P. Contacting the other end of the piston 102, there is a piston rod 104 through the upper end 103 of the body 100.

When the piston rod 104 moves vertically with the piston 102, two switches, 105 and 106, open and close in order. There is a spring 108 installed between the contacting side 107 of the piston rod 104 and the upper end 103 of the body 100 in order to operate the piston 102 to resist the detecting fluid pressure P. Another spring 111 is also installed between the upper end 103 of the body 100 and the spring receiver 110 which is connected to the landing 109. Therefore, when the piston 102 moves and contacts the spring seat 110 to resist the force of the spring 108, the force of the other spring 111 is added to the piston 102.

A fluid pressure switch structured in this way has piston stroke characteristics as shown in FIG. 9. When the detecting fluid pressure P operates one side of the piston 102, the piston 102 and the piston rod 104 rise, resisting the force of the spring 108 with increasing pressure in the pressure area A in FIG. 9, and the detecting fluid pressure P reaches the pressure $P_1$, the piston rod 104 makes the switch 105 operate, and the pressure $P_1$ is detected. When the pressure P increases up to the pressure $P_x$, the piston 102 contacts the spring receiver 110, the force of the other spring 111 is added to it, and the joint force of the two springs 108 and 111 becomes greater than the fluid pressure $P_x$, so the piston 102 and the piston rod 104 stop further upward motion. This motionless state continues through the pressure area B, until the fluid pressure P reaches $P_y$ which can overcome the joint spring force. After that, the fluid pressure P enters the pressure area C, passing the pressure $P_y$, the piston 102 and the piston rod 104 rise again, because the fluid pressure P becomes greater than the joint spring force, and when the fluid pressure P reaches $P_2$, the piston rod 104 activates another switch 106 and $P_2$ is detected.

A fluid pressure switch having the feature described above, has the following merits. The volume of the piston stroke or simply, piston stroke, can be made smaller, even if there is a big difference between detecting pressure levels because the piston 102 and the piston rod 104 stop their motion through the pressure area B, so the whole device can be made to a smaller scale. Another feature is that it has a good detecting performance for the pressure $P_1$, due to the possibility of taking a larger gradient in the low pressure area A.

Despite these merits, however, the following problems occurred. One of such problems is that fluid pressure in the area B cannot be detected, and detecting pressure levels cannot be set in the area B. This problem can be solved by changing the pressure property of the piston strokes in the area B and the area C into the dotted chain line as shown in FIG. 9, but this causes a new problem, i.e., it makes the structure of the device more complicated because it requires the installation of an adjusting system in order to eliminate the area B.

Another problem is the lack of flexibility in designing springs. It is necessary to have precision detection, especially in the low pressure area A. In order to achieve it, the spring constant of the spring 108 for the low pressure area should be made smaller and it is necessary to make the gradient of the piston strokes in the pressure area A, but the spring 108 is compressed not only in the low pressure area A but also in the high pressure area C. Therefore, the strength of the spring for the period of high pressure input has to be considered.

When it comes to the design of the springs, there are many required conditions: the spring constant has to be small; the spring must have sufficient strength to resist the compression; and the size of the spring must be small enough that it does not take a large storage space.

Those are the main points of the problems, but there lies another problem relating to processing precision; detecting performance decreases in the pressure areas right before the pressure reaches $P_x$ or right after the pressure passes $P_y$.

SUMMARY OF THE INVENTION

The object of the invention, therefore, is to provide a single fluid pressure switch capable of detecting at least two distinct pressure levels from an entire range of levels by using a spring arrangement whereby the detection sensitivity is maximized and spring design considerations have been reduced to below that of being critical.

Briefly, the invention consists of a housing element with a single fluid pressure inlet leading to a fluid pressure chamber. A piston element and a diaphragm attached between the piston and housing element, separate the fluid pressure chamber from a spring housing chamber. Located within the spring housing chamber is a multiple spring arrangement and a piston rod formed adjacent the piston element. Fluid pressure entering the fluid pressure chamber urges the piston element upward compressing the multiple spring arrangement which, due to use of a middle body element, exhibits a changing spring constant and further allows uninterrupted motion of the piston in this compression stage.

DESCRIPTION AND OPERATION

Figure 1:
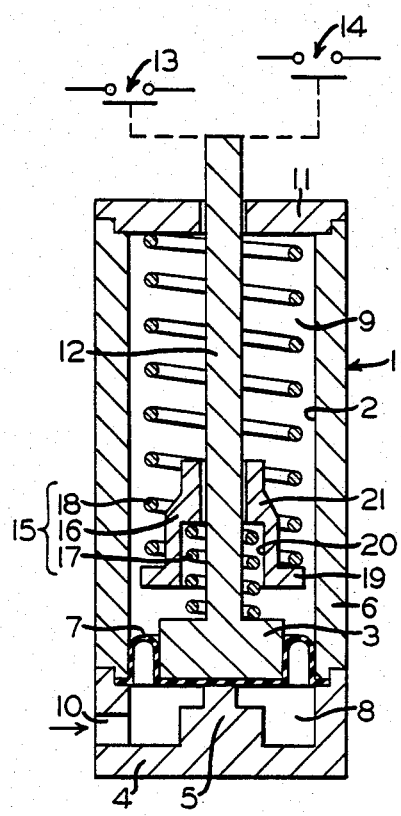
FIG. 1 is a fragmentary view, in section, of the spring arrangement for a fluid pressure switch according to one embodiment of the invention.

The fluid pressure switch in FIG. 1 has a small piston 3 inserted in the cylindrical bore 2 of the cylindrical housing 1. The piston 3 is smaller than the cylindrical bore 2 and installed in a movable way. The piston 3 rests on the protruding inward piston seat 5 of the bottom 4 of the cylindrical housing 1. A plate 22 is attached to the bottom of the piston 3, and the outer circumference of the diaphragm 7 is fixed to the side wall 6 of the cylindrical housing 1 without interrupting the motion of the piston 3. The diaphragm 7 divides the cylindrical bore 2 in the cylindrical housing 1 into a pressure chamber (lower side) 8 and a spring storage chamber (upper side) 9. Fluid pressure is charged and discharged into the pressure chamber 8 through the pressure inlet 10, and the fluid pressure operates upon the bottom side of the piston 3.

This piston 3 has a piston rod 12 which projects out of the top side 11 of the cylindrical housing 1. When this piston rod 12 moves vertically with the piston 3, two switches, 13 and 14, are designed to open and close in order. The detailed explanation for the structure of the switches 13 and 14 is omitted here, and will be explained later in detail in the section based on FIG. 4 and FIG. 5.

In the spring storage chamber 9, there is a double-spring arrangement 15 installed vertically. This double-spring arrangement 15 includes a first spring 17 which has a smaller coil and a second spring 18 which has a larger coil with a middle body 16 contacted in between on the piston rod 12. The middle body 16 can move on the piston rod 12. The lower end of the first spring 17 contacts the piston 3 and the upper end contacts the landing 21 of the stepped recess 20 of the middle body 16. The lower end of the second spring 18 contacts the flange part 19 of the outer circumference of the middle body 16, and the upper end of second spring 18 contacts the top 11 of the body 1. This double-spring arrangement 15 has a structure which is described below. When the piston 3 moves upward under fluid pressure toward the top 11 of the cylindrical housing 1, compressing both springs 17 and 18, the piston 3 and the middle body 16 come into contact, and the first spring 17 reaches the compression yield limit where the spring is not compressed anymore, and after that, only the second spring 18 is compressed until it reaches the compression yield limit. The first spring 17 is then caged within the middle body 16 such that, the force from further movement of the piston 3 does not act on the first spring 17. The first spring 17 is designed to reach the compression yield limit before the second spring 18 does. The spring constants, the size of the springs, and the distance between the piston 3 and the middle body 16 are all calculated based on this relationship.

The two springs 17 and 18 are both compressed until the first spring 17 reaches the compression yield limit before the second spring 18 does, or until the piston 3 contacts the middle body 16, therefore, the total spring constant K of this double-spring arrangement is expressed by equation I.

Now if $K_1$ is the constant for the first spring 17, $nK_1$ ($n>1$) is the constant for the second spring 18, and because the springs are effectively in parallel, the equation becomes:

$$K = \frac{K_1 \cdot nK_1}{K_1 + nK_1} \quad \frac{nK_1}{n+1} \tag{I}$$

After the first spring 17 reaches the compression yield limit, only the second spring 18 is compressed. Then the total spring constant K' is expressed by the following equation (II).

$$K' = nK_1 \tag{II}$$

Therefore, the volume of the piston stroke per unit of pressure, if $P_x$ is the pressure at which the first spring 17 reaches the compression yield limit, becomes the opposite ratio of the total spring constant K in the area below the pressure $P_x$. Thus equation (III) is introduced. In the area past $P_x$, it becomes the opposite ratio of the total spring constant K' as shown in equation (IV). An inequality (V) is established between the two equations.

$$\frac{1}{K} = \frac{n+1}{nK_1} \tag{III}$$

$$\frac{1}{K'} = \frac{1}{nK_1} \tag{IV}$$

$$\frac{n+1}{nK_1} > \frac{1}{nK_1} \tag{V}$$

Figure 2:
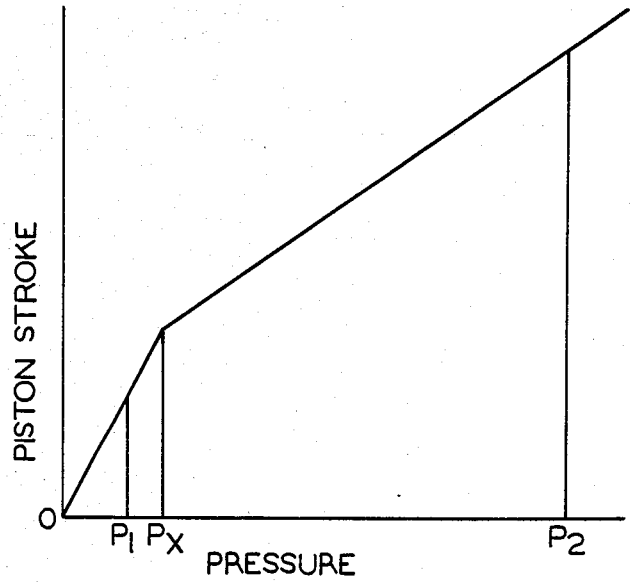
FIG. 2 is a graph illustrating the performance of the fluid pressure switch as embodied in FIG. 1.

Thus, the volume of the piston stroke per unit of pressure is greater in the area below $P_x$, and smaller in the area above $P_x$. The curve of the pressure property, i.e., the piston stroke, is obtained as shown in FIG. 2.

The following is an explanation of the operation of the fluid pressure switch structured as described above and based on FIG. 1 and FIG. 2.

First, the detecting fluid pressure P led to the pressure chamber 8 through the pressure inlet 10 operates the lower side of the piston 3, then the piston 3 begins to move upward toward the top 11 of the cylindrical housing 1 resisting the total spring force of the double-spring arrangement. In the low pressure area, right after the piston motion begins, both of the springs 17 and 18 are not compressed, therefore, the spring arrangement has a small total spring constant K as described before. Thus, the piston 3 moves fast with the piston rod 12 for a large stroke volume per unit of pressure (i. e., large scope) as shown in FIG. 2. At this time, the middle body 16 moves as much as the compression volume of the second spring 18. And, when the fluid pressure in the pressure chamber 8 reaches $P_1$, the piston rod 12 makes the switch 13 operate, then the pressure $P_1$ is detected. When the fluid pressure P rises more and reaches $P_x$, the piston 3 catches up and contacts the middle body 16, then the first spring 17 is no longer compressed, and reaches the compression yield limit.

When the pressure in the pressure chamber 8 passes $P_x$ and enters what can be termed the mid-high pressure area, only the second spring 18, which has not reached the compression yield limit, is compressed, thus the total spring constant of the double-spring arrangement becomes K' as described before. Therefore, the piston stroke grade per unit of pressure decreases as shown in FIG. 2, and the piston 3 keeps moving slowly upward with the piston rod 12. When the fluid pressure reaches $P_2$, the piston rod 12 makes the other switch 14 operate and the pressure $P_2$ is detected. At this point, the second spring 18 has not reached the compression yield limit yet, so, if the pressure rises more, it will be compressed to a correspondingly greater extent.

When the pressure falls after $P_1$ and $P_2$ have been detected, the piston 3, including the piston rod 12, is pushed back by the force of the double-spring arrangement and returns to the original location in FIG. 1.

Figure 3:
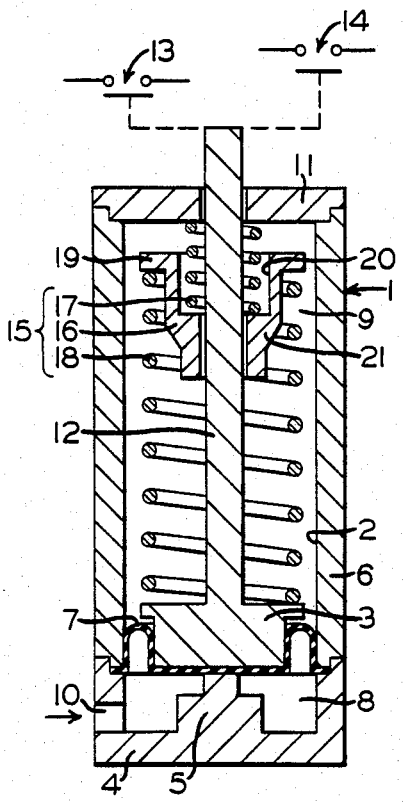
FIG. 3 is a fragmentary view, in section, of the spring arrangement for a fluid pressure switch according to a second embodiment of the invention.

FIG. 3 shows a fluid pressure switch similar to the first embodiment of the invention. Let us compare it with the fluid pressure switch shown in FIG. 1. The double-spring arrangement here is installed upside down and the first spring 17 is designed to reach the compression yield limit when the middle body 16 comes into contact with the top 11 of the cylindrical housing 1. The rest of the structure is the same as the embodiment of FIG. 1. Therefore, this fluid pressure switch also has the same pressure property (piston stroke) shown in FIG. 2 as the fluid pressure switch of FIG. 1 does. Elements common with FIG. 1, the reference numbers, and explanations of the structure for FIG. 3 are omitted.

Figure 4:
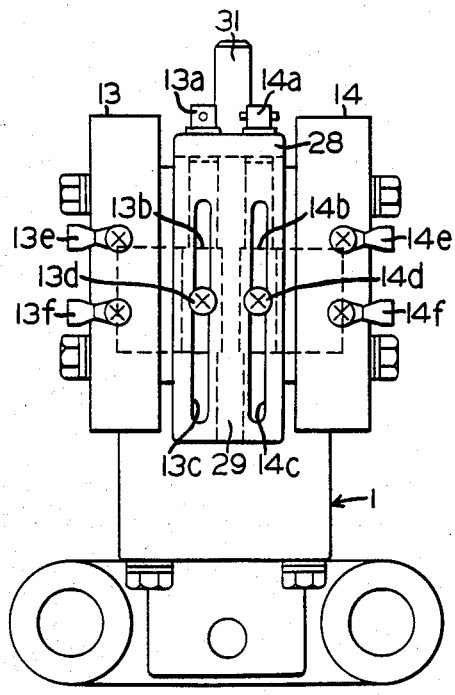
FIG. 4 is a plan view of a fluid pressure switch embodying the invention.
Figure 5:
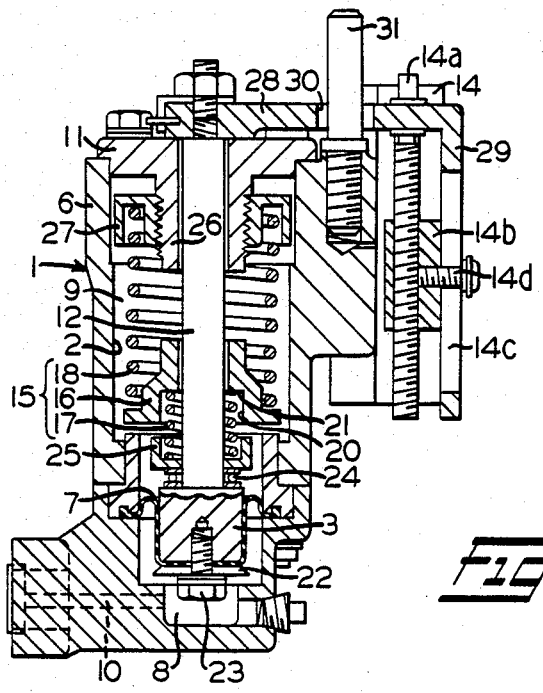
FIG. 5 is an elevational view, in section, of a fluid pressure switch according to the embodiment of FIG. 1.

FIG. 4 and FIG. 5 show the fluid pressure switch of the first embodiment whereby the switch arrangement is detailed in element rather than symbol form. Referring to FIG. 5, in this fluid pressure switch, a diaphragm 7, which divides the cylindrical bore 2 of the cylindrical housing 1 into the pressure chamber 8 and the spring storage chamber 9, is fixed securely to the bottom of the piston 3 with a holding plate 22 and a bolt 23. On top of the piston 3, surrounding the piston rod 12, there is a thrust bearing 24 and a spring seat 25 which isolate the twists of the spring from the diaphragm 7. On the top 11 of the cylindrical housing 1, there is an inwardly extending cylindrical body 26 formed downward through which the piston rod 12 passes. On a tapered lower portion of the cylindrical body 26, a second spring seat 27 is attached.

The double-spring arrangement is installed between the two spring seats 25, 27. The end of the first spring 17 contacts the first spring receiver 25 and the other end contacts the landing 21 of the body recess 20 of the middle body 16. The end of the second spring 18 contacts the flange part 19 of the outer circumference of the middle body 16, and the other end contacts the second spring seat 27. Therefore, the whole length of the double-spring 15 can be easily changed by turning and moving the second spring seat 27 vertically. Thus, the spring force can be freely adjusted. This is not shown in a figure, but it is possible to design the body structure in order to adjust the spring force from outside the cylindrical housing 1, providing a window near the second spring seat 27 on the body wall 6, and either the operator's finger or an elongated tool can be inserted to turn the second spring seat 27.

Furthermore, there is an interlocking arm 28 fixed to the protruding part of the piston rod 12. As seen in FIG. 4, this interlocking arm 28 has a downwardly projecting portion 29 which is parallel with the piston rod 12 and which moves vertically with the piston rod 12. As seen in FIG. 5, in the guide rod opening 30 of the interlocking arm 28, there is a guiding rod 31 standing in parallel with the piston rod 12. This guiding rod 31 guides the vertical motion of the interlocking arm 28, and at the same time it prevents the interlocking arm 28 from turning around the piston rod 12. Referring again to FIG. 4, it can be seen that a pair of adjusting screw rods **13*a*, 14*a* are installed with free rotation in the interlocking arm 28 along the parallel portion 29. The adjusting screw rods 13*a*, 14*a* have adjacent blocking elements 13*b*, 14*b* which are connected. The blocking elements 13*b*, 14*b* are fixed securely to the parallel portion 29 by setting screws 13*d* and 14*d* through the guide slots 13*c* and 14*c* which are provided in the parallel portion 29. Therefore, if the adjusting screw rods 13*a* and 14*a* are turned by loosening the setting screws 13*d*, 14*d*, the adjacent blocking elements 13*b*, 14*b* can be moved along the guide slots 13*c*, 14*c*, and by tightening the setting screws 13*d*, 14*d* at requested locations, the adjacent blocking elements 13*b*, 14*b*** will be adjusted freely.

As seen in FIG. 4, a pair of adjacent magnetic switches 13 and 14, commonly called Reed switches, are installed on both sides of the interlocking arm 28. The adjacent blocking elements **13*b*, 14*b* which block magnetic flux are inserted in a groove (not shown in the figures) between switch elements (not shown) and magnet(s) (not shown) which are contained within each switch body 13, 14, without contacting that switch body. Therefore, if the adjacent blocking elements 13*b*, 14*b* are placed between the switch components and magnets to block magnetic flux, the switch contacts will open, and, if the adjacent blocking elements 13*b*, 14*b* are off the switch components, the contacts will close by themselves. In FIG. 4, 13*e*, 13*f*, 14*e*, and 14*f* are terminal connections to the switch contacts in the switch bodies 13, 14** to which the external circuitry (not shown) can be connected.

The following is an explanation of the operation of a fluid pressure switch which has the structure described above. First, in accordance with the increase in the fluid pressure which is led to the pressure chamber 8 through the pressure inlet 10, the piston 3 moves swiftly upward in a large stroke volume per unit of pressure compressing the double-spring arrangement, both the first spring 17 and the second spring 18. Then the interlocking arm 28 which is fixed to the piston rod 12 moves upward. It is guided by the guiding rod 31 so as not to turn around the piston rod 12. The adjusting screw rod 31 installed on the interlocking arm 28, and the adjacent locking elements **13*b*, 14*b* installed on the parallel portion 29 of the end of the interlocking arm 28, move upward together. In this case, using the method (location adjusting) mentioned before, both blocking elements 13*b*, 14*b* are slid up or down along the guide slots 13*c* and 14*c* only by the compression volume of the double-spring arrangement which is equivalent to the pressure difference between $P_1$ and $P_2$ (not shown in FIG. 2). In the low pressure (below $P_1$) area, the first blocking element 13*b* is adjusted beforehand to position where it does not block magnetism between the switch components and the magnet of the switch 13. Therefore, in the area where the pressure is lower than $P_1$, even when both blocking elements 13*b* and 14*b* rise by the upward motion of the piston 3 and the piston rod 12, both switch contacts stay "on" without being blocked by the magnetism-blocking adjacent blocking elements 13*b*, 14*b***.

When the fluid pressure in the pressure chamber 8 reaches $P_1$, the first blocking element 13*b* blocks the field between the switch component and the magnet of the switch 13. Then the switch contact opens and the pressure $P_1$ is detected. When the fluid pressure increases and reaches the pressure $P_x$, the spring receiver 25 catches up and contacts the middle body 16, and the first spring 17 reaches the compression yield limit.

When the fluid pressure passes $P_x$ and enters the mid-high pressure area, only the second spring 18 is further compressed. Thus, the piston 3, the piston rod 12, the interlocking arm 28, the blocking elements 13*b*, 14*b*, and the adjusting screw rods 13*a*, 14*a* continue moving slowly upward by the small stroke volume per unit of pressure which is inversely proportional to the spring constant of the second spring 18. As was described above, the volume of the piston stroke per unit of pressure is greater in the low pressure area where P is below $P_x$, and is smaller in the mid-high pressure area where P is above $P_x$. The property of the pressure (piston stroke) shown in FIG. 2 is exactly the same as in the fluid pressure switches of FIG. 1 and FIG. 3. When the fluid pressure reaches $P_2$, the second blocking element 14*b* blocks the field between the switch component and the magnet of the switch 14. The switch contact opens and the pressure $P_2$ is detected.

In the operation described above, the detection of pressure is done when the switch contacts of the switches 13, 14 are turned from "on" to "off", but this method might be changed depending on the types of the connection of the electric circuits of the compressor or the power relay which are connected to the switches 13, 14, and the detection of pressure will be carried out when the switches change from "off" to "on".

Figure 6:
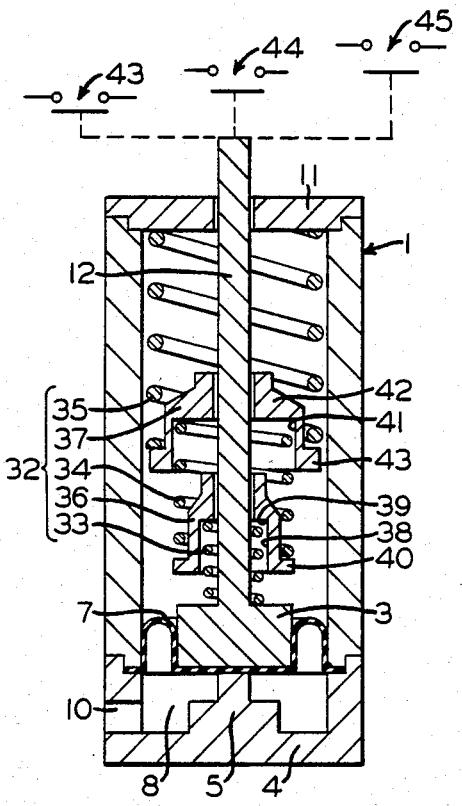
FIG. 6 is a fragmentary view, in section, of the spring arrangement for a fluid pressure switch according to a third embodiment of the invention.

As seen in FIG. 6, the fluid pressure switch, by a third embodiment, has a structure to operate the spring force at the piston against the fluid pressure operating the other side of the piston; more than three springs are placed in series (arranged vertically) through two or more middle bodies in between and on the piston rod. These springs are designed and structured to reach the compression yield limit one by one in order.

For a multiple-spring system, the embodiment of FIG. 6 adopts three springs in the system. The following is an explanation of the fluid pressure switch by this embodiment.

Obviously, the difference between the switches of FIG. 1 and FIG. 6 is the number of springs. In FIG. 6, there is shown a triple-spring arrangement and three switches 43, 44, 45 which are opened and closed by the motion of the piston rod 12 for detecting pressure levels at three points. The rest of the structure of the switch is the same as that shown in FIG. 1 of the first embodiment.

This triple-spring arrangement includes a small-sized first spring 33 and a medium-sized second spring 34. There is a small middle body 36 between them on the piston rod 12, and the medium-sized second spring 34 and a large-sized third spring 35 are also placed vertically by way of a larger middle body 37 on the piston rod 12. The lower end of the first spring 33 contacts the bottom of the piston 3 and the upper end contacts the landing 39 of the stepped recess 38 of the middle body 36. With the second spring 34, the lower end contacts the flange part 40 of the outer circumference of the middle body 36 and the upper end contacts the landing 42 of the stepped recess 41 of the larger middle body 37. With the third spring 35, the lower end contacts the flange part 43 of the outer circumference of the larger middle body 37, and the upper end contacts the top 11 of the cylindrical housing 1.

When the piston 3 begins its upward motion, the first spring 33, the second spring 34, and the third spring 35 are compressed together. Then, the larger middle body 37 moves as much as the volume of compression of the third spring 35, and the smaller middle body 36 moves as much as the total volume of compression of the second spring 34 and the third spring 35. But, first, the piston 3 contacts the smaller middle body 36 and the first spring 33 reaches the compression yield limit. Similar to the first spring 17 shown in FIGS. 1 and 3, the first spring 33 is caged in the middle body 36 and isolated from further piston force. Next, the middle body 36 contacts the landing 42 of the larger middle body 37, and the second spring 34 reaches the compression yield limit, the second spring 34 now caged and isolated from further piston force. After that, only the third spring 35 is compressed until it reaches the compression yield limit. In other words, the first spring 33 reaches the compression yield limit sooner than the second spring 34 does, and the second spring 34 reaches that limit sooner than the third spring 35 does. Each spring constant for each spring, the sizes of those springs, the distance between the piston 3 and the middle body 36, and the distance between two middle bodies 36 and 37 are all designed and structured to the required function.

Figure 7:
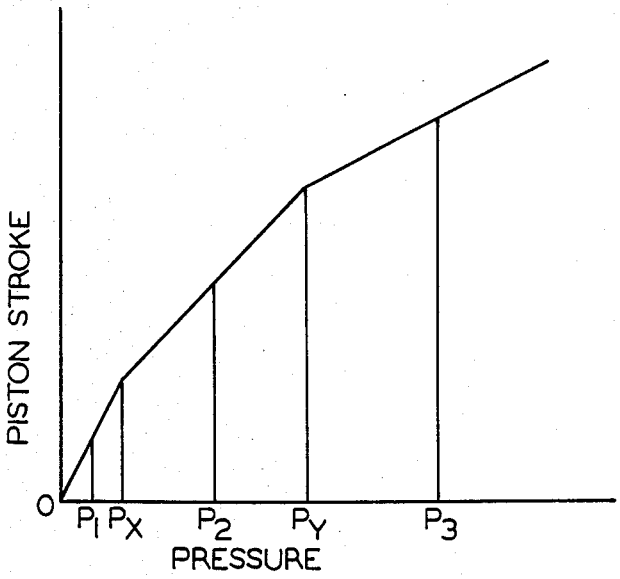
FIG. 7 is a graph illustrating the performance of the fluid pressure switch as embodied in FIG. 6.
Figure 8:
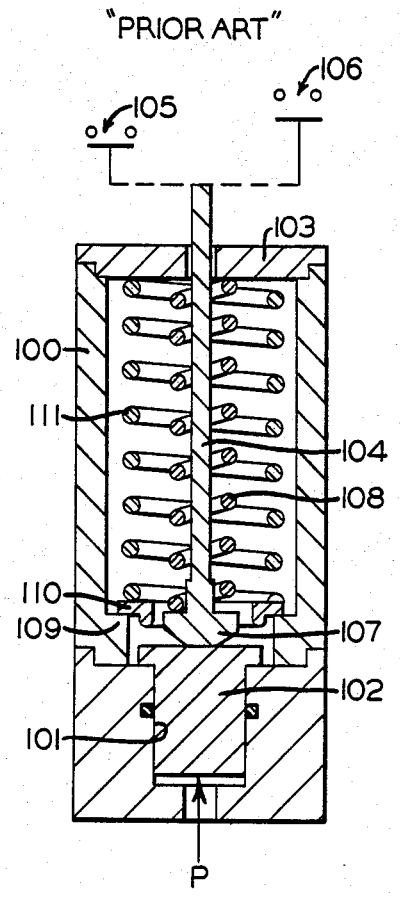
FIG. 8 is a fragmentary view, in section, of a fluid pressure switch according to the prior art.
Figure 9:
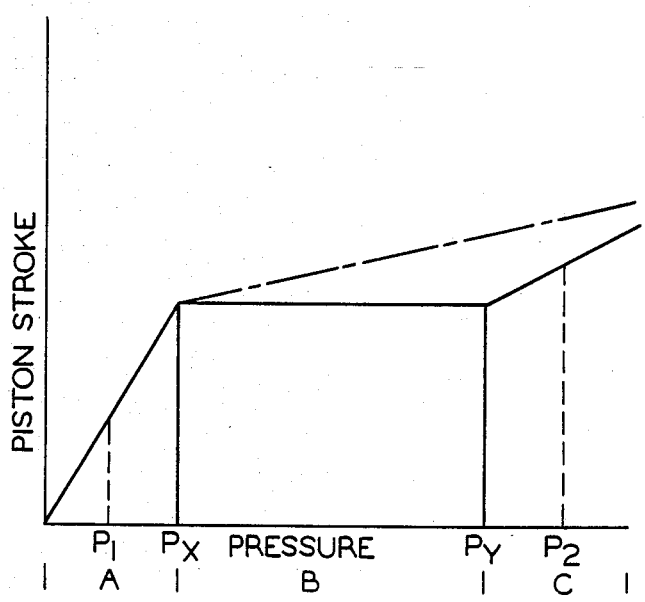
FIG. 9 is a graph illustrating the performance of the fluid pressure switch as embodied in FIG. 8.

As each spring reaches the compression yield limit, during the period when the first spring 33 reaches it, the multiple-spring arrangement has a small total spring constant which is determined by each spring constant of the first spring 33, the second spring 34, and the third spring 35. During the period when the second spring 34 reaches the compression yield limit after the first spring 33 has reached it, the multiple-spring arrangement has a slightly larger total constant which is determined by each spring constant of the second spring 34 and the third spring 35. After the period when the first spring 33 and the second spring 34 have reached the compression yield limit, the multiple-spring arrangement has a large total spring constant equivalent to the spring constant of the third spring 35. As seen in FIG. 7, therefore, if $P_x$ is set for the detecting fluid pressure in the pressure chamber 8 when the first spring 33 reaches the compression yield limit, and $P_y$, when the second spring 34 reaches the compression yield limit, the volume of the piston stroke per unit of pressure becomes the inverse ratio of the total spring constant of the multiple-spring arrangement. Thus, in the low pressure area where the pressure is below $P_x$, the volume of the piston stroke is greatest. In the mid-pressure area between $P_x$ and $P_y$, the volume of the piston stroke decreases, and in the high pressure area above $P_y$, the volume of the piston stroke decreases further. FIG. 7 shows the curve of the piston stroke and the operating pressure.

In the same way, if more than four springs are placed in the system, the volume of the piston stroke per unit of pressure decreases by changing more than four steps. This should be easily understood.

On the other hand, three switches 43, 44, 45 which are opened and closed by the motion of the piston rod 12, are the same as the ones shown in FIG. 4 and FIG. 5 described above. Also, the other part of this fluid pressure switch is structured in the same way as in FIG. 1, so the same numbers appear in FIG. 6 for the identical parts of the structure, and an explanation of the operation is omitted.

In the case of this third embodiment of the fluid pressure switch, the structure can be changed; a multiple-spring arrangement or a triple-spring arrangement can be installed upside down, or the order of the springs can be changed, or the double-spring arrangement in FIG. 5 can be replaced with a multiple-spring system.

The following explanation is the operation of the fluid pressure switch shown in FIG. 6 and FIG. 7.

On receiving the detecting fluid pressure which is led from the pressure inlet 10 of the pressure chamber 8, the piston 3 begins its upward motion with the piston rod 12 to resist the total spring force of the multiple-spring arrangement. At this time, the first spring 33, the second spring 34, and the third spring 35 are not compressed, and the total spring constant is small, so the piston 3 rises fast in a large volume of stroke per unit of pressure as is shown in the low pressure area of FIG. 7. At the same time, the larger middle body 37 rises just as much as the volume of compression of the third spring 35, and the smaller middle body 36 rises just as much as the total volume of compression of the second spring 34 and the third spring 35. When the pressure reaches $P_1$, the piston rod 12 makes the switch 43 operate and the pressure $P_1$ is detected. When the pressure reaches $P_x$, the piston 3 catches up and contacts with the smaller middle body 36, so the first spring 33 is not compressed anymore and reaches the compression yield limit.

When the pressure in the pressure chamber 8 passes $P_x$ and enters the mid-pressure area, the second spring 34 and the third spring 35 which have not reached the compression yield limit, are compressed, so the total spring constant which is determined by each spring constant of the second spring 34 and the third spring 35 becomes slightly larger than before, and the piston 3 continues its upward motion slowly with the piston rod 12 in the slightly smaller volume of stroke per unit of pressure as is shown in FIG. 7. When the detecting fluid pressure reaches $P_2$, the piston rod 12 makes the switch 44 operate, and $P_2$ is detected. When the pressure increases more and reaches $P_y$, the smaller middle body 36 contacts the larger middle body 37 on the landing 42 of the stepped recess 41. The second spring 34 is not compressed anymore and reaches the compression yield limit.

The pressure passes $P_y$ and enters the high pressure area and only the third spring 35 which has not reached the compression yield limit is compressed, so the total spring constant is large and equivalent to the spring constant of the third spring 35, and the piston 3 continues its upward motion with the piston rod 12 more slowly than before in the volume of small stroke per unit of pressure as shown in FIG. 7. When the pressure reaches $P_3$, the piston rod 12 makes the switch 45 operate and $P_3$ is detected. At this time, the third spring 35 has not reached the compression yield limit, and when the pressure further increases, the third spring 35 is correspondingly compressed.

When the pressure decreases after $P_1$, $P_2$ and $P_3$ were detected as described above, the piston 3 is pushed back with the piston rod 12 by the spring force of the multiple-spring arrangement and returned to the original location as shown in FIG. 6.

Therefore, both the double-spring arrangement and multiple-spring arrangement allow continuous piston 3 motion with the piston rod 12 without stopping in any pressure area, thus the detecting pressure levels can be chosen and set arbitrarily through the entire pressure range. Moreover, the first spring 17 of the double-spring arrangement and the first and second springs 33, 34 of the multiple-spring arrangement can be of a small spring strength since these springs reach their respective compression yield limit at such a relatively small pressure value. This smaller initial stage spring constant means that the total spring constant is minimized, thereby allowing a larger volume of piston stroke per unit of pressure which ultimately translates into a fluid pressure switch of minimum size.

In all the operations described before, the piston 3 and the piston rod 12 are formed together in one body, but alternate structures can be designed for the embodiments of FIG. 1, FIG. 3, and FIG. 6 where the piston 3 is stopped at the piston seat 5; the piston 3 can be separated from the piston rod 12, but they are placed so as to contact each other, and a spring receiver is installed on a proper place of the piston rod, and one end of a double-spring system or a multiple-spring system can sit on the spring receivers.

Although the hereinabove-described form of embodiments of the invention constitute preferred forms, it can be appreciated that other modifications may be made thereto without departing from the scope of the invention as set forth in the appended claims.

We claim:

1. A fluid pressure device for operating two or more switch devices upon the detection of two or more distinct fluid pressure levels from a varied range of fluid pressure, said fluid pressure device comprising:

(a) a housing having a cylindrical bore formed therein, said housing further having a pressure inlet communicating with said cylindrical bore;

(b) a piston member axially movable within said cylindrical bore;

(c) a piston rod extending from said piston member and moving therewith, said piston rod having an external portion extending through an opening formed in said housing;

(d) spring means axially surrounding said piston rod for opposing movement of said piston member, said spring means having a spring coefficient which is nonlinear and which changes by at least one increment in response to a predetermined displacement of said piston member, said spring means including a plurality of springs serially arranged surrounding said piston rod;

(e) switch operating means disposed externally of said housing and operably connected to said external portion of said piston rod for selectively operating the switch devices; and (f) limiting means cooperatively engaging said spring means for independently limiting axial compression of said spring means, and, said limiting means having a middle body member disposed between said first and second spring members such that said first spring member becomes caged by said middle body member upon said piston member reaching a first predetermined piston displacement, said middle body member having a narrow guide end in surrounding proximity to said piston rod, said narrow guide end, upon said piston member reaching a second predetermined piston displacement, contacting a portion of said housing such that said middle body member is rigidly supported by said housing portion.

2. A fluid pressure device, as set forth in claim 1, wherein said plurality of springs comprises a first spring and a second spring.

3. A fluid pressure device, as set forth in claim 1, wherein said switch operating means includes an interlocking arm connected to said external portion of said piston rod and a first and a second blocking element connected to said interlocking arm, said first and said second blocking elements being effective to operate such switch devices upon detection of a predetermined level of such fluid pressure.

4. A fluid pressure device, as set forth in claim 3, wherein said interlocking arm has a top portion connected to said external portion of said piston rod and a side portion projecting downwardly along the side of said housing, said side portion having first and second guide slots formed therein, said first and second guide slots receiving said first and said second blocking elements to allow adjustments therein.

5. A fluid pressure device, as set forth in claim 3, further comprising a guide rod slot formed in said interlocking arm, and a guide rod secured to said housing, said guide rod projecting through said guide rod slot and preventing rotational movement of said interlocking arm about said piston rod.

6. A fluid pressure device, as set forth in claim 2, further comprising a first spring seat disposed between said piston member and said first spring member, said first spring seat having a larger diameter than said first spring and further having an extending abutment portion to contact said middle body member, thereby limiting further compression of said first spring member.

7. A fluid pressure device, as set forth in claim 6, further comprising a thrust bearing disposed between said piston member and said first spring seat.

8. A fluid pressure device, as set forth in claim 2, further comprising a second spring seat disposed between said second spring and said portion of said housing.

9. A fluid pressure device, as set forth in claim 2, wherein said middle body member has a stepped recess on which one end of said first spring contacts and a flange portion on which one end of said second spring contacts.

10. A fluid pressure device, as set forth in claim 1, wherein said plurality of springs includes a first spring, a second spring and a third spring; and said middle body member is disposed between said first and said second spring members such that said first spring member becomes caged by said middle body member upon said piston member reaching such first predetermined piston displacement, said limiting means further including a second middle body member disposed between said second and said third spring members such that said second spring member becomes caged by said second middle body member upon said piston member reaching a third predetermined piston displacement greater than said first piston displacement.

11. A fluid pressure device, as set forth in claim 10, wherein said first middle body member has a first stepped recess on which one end of said first spring contacts and a first flange portion on which one end of said second spring contacts; and further wherein said second middle body has a second stepped recess on which a second end of said second spring contacts and a second flange portion on which one end of said third spring contacts.

12. A fluid pressure device, as set forth in claim 6, wherein said middle body member has a stepped recess on which one end of said first spring contacts and a flange portion on which one end of said second spring contacts.

13. A fluid pressure device, as set forth in claim 12, wherein said switch operating means includes an interlocking arm connected to said piston rod and a first and a second blocking element adjustably connected to guide slots formed in said interlocking arm.

14. A fluid pressure device, as set forth in claim 6, wherein said housing portion is a cylindrical body member disposed in surrounding relation to a portion of said piston rod, said cylindrical body having a top portion which forms an upper side to said housing and a lower tapered portion extending downward from said top portion.

15. A fluid pressure device, as set forth in claim 14, further comprising a second spring seat adjustably, rigidly, connected to said lower tapered portion of said cylindrical body, said second spring seat contacting one end of said second spring member.

16. A fluid pressure device, as set forth in claim 15, further comprising a window formed in said housing to allow external adjusting of said second spring seat along said tapered portion of said cylindrical body, thereby changing compression limits of said first and said second spring members.

* * * * *